US005925982A

United States Patent [19]

Liu

[11] Patent Number: 5,925,982

[45] Date of Patent: Jul. 20, 1999

[54] POWER SUPPLY CIRCUIT FOR INTERMITTENTLY ACTUATING A FILAMENT OF A VACUUM FLUORESCENT DISPLAY

[75] Inventor: Yao-Sheng Liu, Taipei Hsien, Taiwan

[73] Assignee: Behavior Tech Computer Corporation, Taipei, Taiwan

[21] Appl. No.: 08/948,532

[22] Filed: Oct. 9, 1997

[51] Int. Cl.[6] ..... H05B 37/02

[52] U.S. Cl. ..... 315/105; 315/209 R; 315/219; 315/291

[58] Field of Search ..... 315/105, 106, 315/107, 209 R, 219, 220, 223, 224, 225, 291, 307, 308, DIG. 5, 160, 169.1, 165, 166

[56] References Cited

U.S. PATENT DOCUMENTS 5,262,699 11/1993 Sun et al. ..... 315/209 R

*Primary Examiner*—Don Wong

*Assistant Examiner*—David H. Vu

*Attorney, Agent, or Firm*—Heller Ehrman White & McAuliffe

[57] ABSTRACT

A power supply circuit for a filament of a vacuum fluorescent display includes an LC series circuit and a capacitor. A first end of the LC series circuit is connected with a secondary winding of a transformer in a switching power supply, and a second end of the LC series circuit is connected with a first end of the filament. A first end of the capacitor is connected with a second end of the filament, and a second end of the capacitor is directly or indirectly connected with a ground source. The LC series circuit and the capacitor form a series resonance circuit, thereby providing an isolated power supply for the filament of the vacuum fluorescent display.

2 Claims, 2 Drawing Sheets

POWER SUPPLY CIRCUIT FOR INTERMITTENTLY ACTUATING A FILAMENT OF A VACUUM FLUORESCENT DISPLAY

BACKGROUND OF THE INVENTION

1. Field of the Invention

The present invention generally relates to a power supply circuit and, more particularly, to a power supply circuit for intermittently actuating a filament of a vacuum fluorescent display.

2. Description of Related Art

A vacuum fluorescent display (VFD) has been widely applied to various products such as phonographic equipment, video recorders, CD (compact disc) players and VCD (video compact disc) players. An isolated power supply is usually used for a filament of a vacuum fluorescent display; otherwise, a malfunction may occur in the vacuum fluorescent display.

In general, a switching power supply is used to provide an isolated power for a filament of a vacuum fluorescent display, and provides other power supplies for use in the vacuum fluorescent display.

As shown in FIG. 2, a conventional switching power supply for a VCD player (not shown) provides a set of various DC (direct current) voltage signals for use in the VCD player. As the switching power supply is conventional technology, thus a detailed description thereof is omitted here.

In FIG. 2, the ends (VF+, VF−) of a filament of a vacuum fluorescent display FT1 are connected with an inverter 50 which is comprised of a transformer 51 and two transistors 52 and 53. The inverter 50 receives a DC voltage (+5 volts) from the switching power supply, generates a high-frequency oscillation therein, and then sends an AC (alternate current) voltage (with an amplitude of five volts) from a secondary winding of the transformer 51 to the filament of the vacuum fluorescent display. Therefore, an isolated power supply can be provided for the filament of the vacuum fluorescent display by using the inverter 50.

In addition, a signal MPO in FIG. 2 is a control signal for controlling the power supply of the filament. The control signal MPO can intermittently actuate the filament at a high frequency by using a plurality of transistors, thereby to prolong the lifetime of the vacuum fluorescent display.

However, the above-described switching power supply using the inverter 50, which provides an isolated power supply for a filament of a vacuum fluorescent display, has a complicated circuit structure. Therefore, there is a need to contrive a power supply circuit with a more simplified structure which can provide the filament of a vacuum fluorescent display with an isolated power supply.

SUMMARY OF THE INVENTION

One object of the present invention is to provide a power supply circuit with a simplified structure which can provide an isolated power supply for a filament of a vacuum fluorescent display.

Another object of the present invention is to provide a power supply circuit for a filament of a vacuum fluorescent display, wherein the filament can be intermittently actuated so as to prolong its lifetime.

In accordance with one aspect of the present invention, an AC signal isolated from a main source is directly drawn from a low voltage AC output terminal of a switching power supply through an LC (inductor-capacitor) series circuit, and then the isolated AC signal is supplied to a first end of a filament of a vacuum fluorescent display. A second end of the filament is connected to a ground source through a capacitor, and thus can be effectively isolated from the ground source through the utilization of the capacitor. As a result, a power supply circuit for a filament of a vacuum fluorescent display can be made by employing only three passive components, therefore, the structure of the power supply circuit can be simplified.

In accordance with another aspect of the present invention, a control circuit for intermittently actuating the filament comprises a plurality of transistors and is connected between the capacitor and the ground source, so as to intermittently actuate the filament.

BRIEF DESCRIPTION OF THE DRAWINGS

Other objects, advantages and features of the invention will become more apparent from the following detailed description when taken in conjunction with the accompanying drawings, in which.

DETAILED DESCRIPTION OF PREFERRED EMBODIMENT

Figure 1:
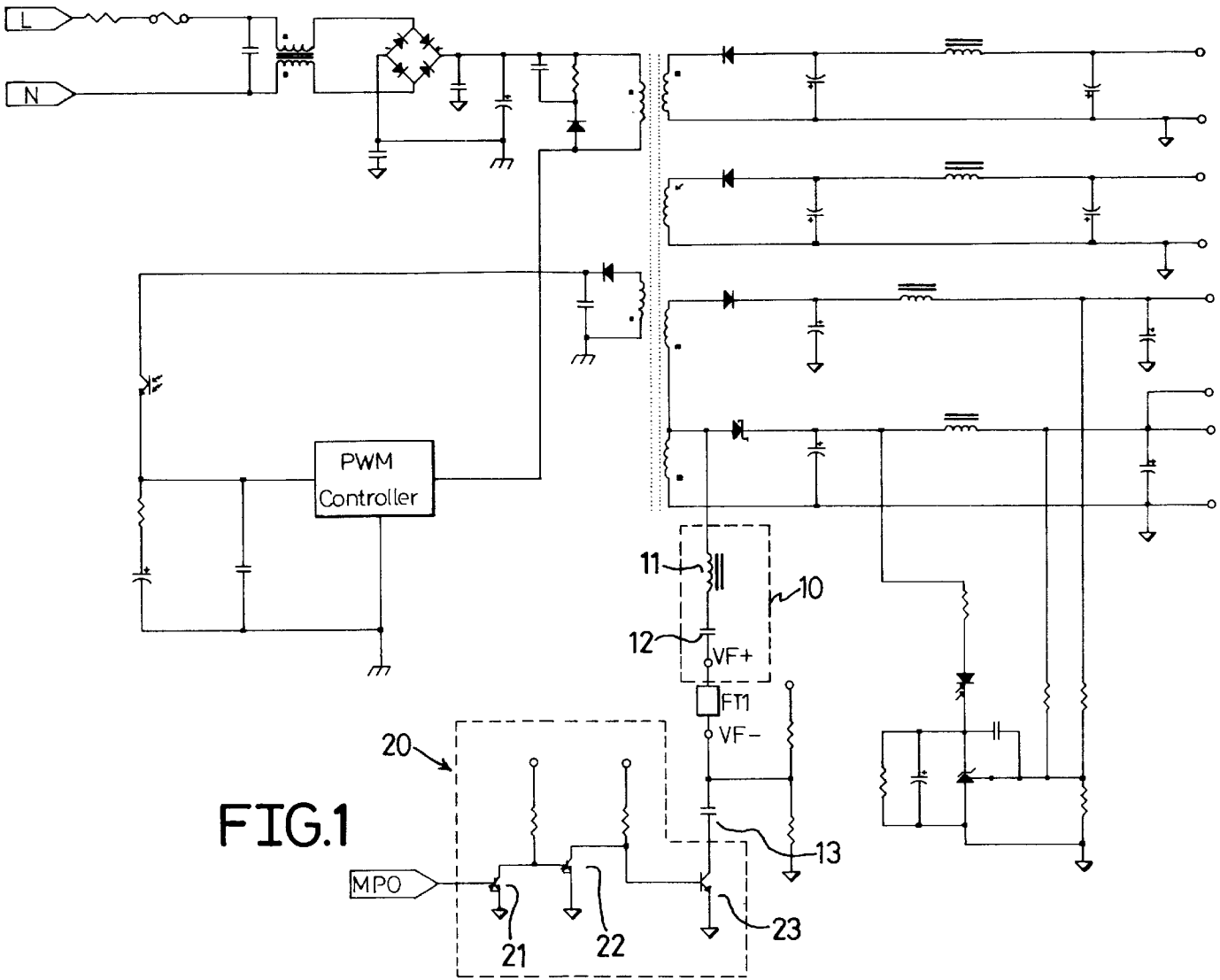
FIG. 1 shows a power supply circuit for a filament of a vacuum fluorescent display in accordance with an embodiment of the present invention.

As shown in FIG. 1, a power supply circuit for a filament of a vacuum fluorescent display in accordance with the present invention comprises an LC series circuit 10 and a capacitor 13. The LC series circuit 10 and the capacitor 13 are respectively connected to one of the ends (VF+, VF−) of the filament of the vacuum fluorescent display FT1.

The LC series circuit 10 is formed by serially connecting an inductor 11 and a capacitor 12, and one end (other than the "VF+" end) of the LC series circuit 10 is directly connected with a secondary winding of a high frequency transformer in a switching power supply. For example, the amplitude of the output voltage of the secondary winding is 5 volts.

The operating frequency (oscillation frequency) of the switching power supply is relatively high (for example, about 100 KHz), and the secondary winding of the high frequency transformer is electrically coupled to the "VF+" end of the filament through the LC series circuit. As a result, the "VF+" end of the filament is electrically coupled to but isolated from the switching power supply.

The "VF−" end of the filament is sequentially connected to the capacitor 13, a control circuit 20 for intermittently actuating the filament, and the ground source. As a result, the "VF−" end of the filament is electrically connected to but isolated from the ground source.

The LC series circuit 10 together with the capacitor 13 form a series resonance circuit, for example, its resonance frequency is about 100 KHz.

The control circuit 20 for intermittently actuating the filament comprises a plurality of transistors 21, 22 and 23. A control signal MPO generated by other circuits of the vacuum fluorescent display is inputted to the control circuit 20 (i.e., the base of the transistor 21), such that the transistor 23 serially connected with the capacitor 13 is intermittently turned on. As a result, the filament is intermittently actuated so as to prolong its lifetime.

Figure 2:
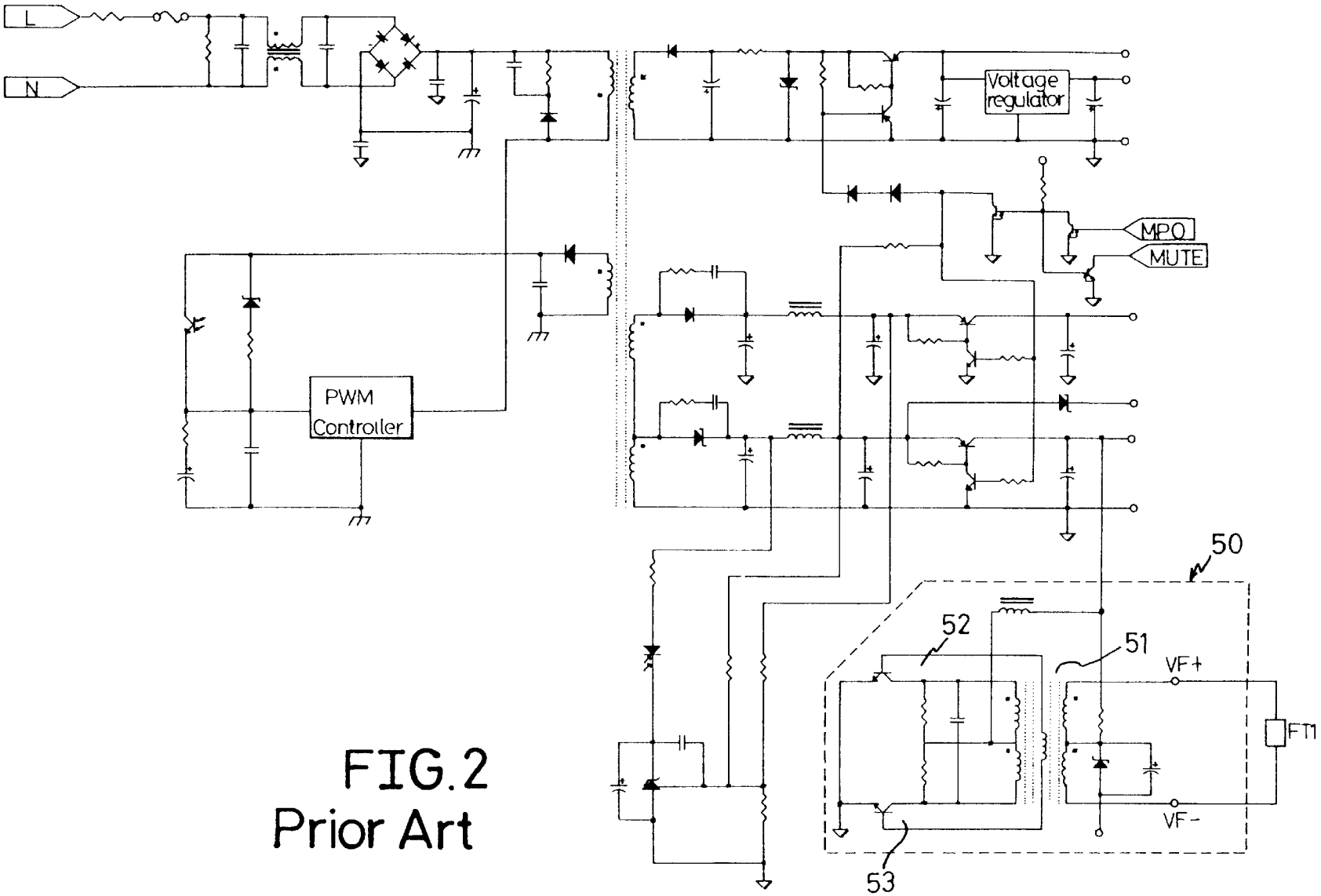
FIG. 2 Prior Art
FIG. 2 shows a conventional power supply circuit for a filament of a vacuum fluorescent display.

However, the function and effectiveness of the control circuit 20 for intermittently actuating the filament is similar to the conventional technology as shown in FIG. 2. Therefore, the detailed description concerning the control circuit 20 is omitted here.

When the control signal MPO turns on the transistor 23, the capacitor 13 is electrically connected to the ground source and serves as an isolation device between the "VF−" end of the filament and the ground source.

As the ends (VF+, VF−) of the filament are respectively isolated from the switching power supply and the ground source through the LC series circuit 10 and the capacitor 13, an isolated power supply for the filament of the vacuum fluorescent display is provided by the invention.

Preferably, the resonance frequency of the series resonance circuit made of the LC series circuit 10 and the capacitor 13 is set to be identical to the operating frequency (oscillation frequency) of the switching power supply, for example, about 100 KHz.

As a result, according to the invention, an isolated power supply can be applied to the filament of the vacuum fluorescent display, and thus the filament will properly operate.

It is to be understood, however, that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed.

What is claimed is:

1. A power supply circuit for intermittently actuating a filament of a vacuum fluorescent display, comprising:

an LC series circuit, a first end of which connects with a secondary winding of a transformer in a switching power supply, and a second end of which connects with a first end of said filament;

a first capacitor, a first end of which connects with a second end of said filament, and a second end of which directly or indirectly electrically connects with a ground source; and a control circuit for intermittently actuating said filament, said control circuit being serially connected between said first capacitor and said ground source, wherein said LC series circuit comprises an inductor and a second capacitor, and said LC series circuit and said first capacitor form a series resonance circuit, thereby providing an isolated power supply for intermittently actuating said filament of said vacuum fluorescent display.

2. The circuit of claim 1, wherein said control circuit comprises a plurality of transistors.

* * * * *